US007506687B2

(12) United States Patent
Ring

(10) Patent No.: US 7,506,687 B2
(45) Date of Patent: Mar. 24, 2009

(54) SYSTEM FOR RADIALLY EXPANDING A TUBULAR MEMBER

(75) Inventor: Lev Ring, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 0 days.

(21) Appl. No.: 12/031,780

(22) Filed: Feb. 15, 2008

(65) Prior Publication Data

US 2008/0135262 A1 Jun. 12, 2008

Related U.S. Application Data

(63) Continuation of application No. 10/516,117, filed as application No. PCT/US03/11765 on Apr. 17, 2003, now Pat. No. 7,360,591.

(60) Provisional application No. 60/383,917, filed on May 29, 2002.

(51) Int. Cl.
*E21B 23/00* (2006.01)
*E21B 43/10* (2006.01)

(52) U.S. Cl. ..... 166/207; 166/382; 285/382.5

(58) Field of Classification Search ..... 166/206, 166/207, 277, 382, 384; 285/382.4, 382.5
See application file for complete search history.

(56) References Cited

U.S. PATENT DOCUMENTS 4,069,573 A * 1/1978 Rogers et al. ..... 29/890.031
6,668,930 B2 * 12/2003 Hoffman ..... 166/298

* cited by examiner

*Primary Examiner*—Giovanna C Wright
(74) *Attorney, Agent, or Firm*—Conley Rose, P.C.

(57) ABSTRACT

A system for radially expanding a tubular member.

34 Claims, 16 Drawing Sheets

SYSTEM FOR RADIALLY EXPANDING A TUBULAR MEMBER

CROSS REFERENCE TO RELATED APPLICATIONS

The present application is a continuation application of U.S. non-provisional application Ser. No. 10/516,117 which was filed on May 2, 2005, now U.S. Pat. No. 7,360,591 and is entitled "System For Radially Expanding A Tubular Member," which is the National Stage patent application for PCT patent application Ser. No. PCT/US2003/011765, filed on Apr. 17, 2003, which claimed the benefit of the filing dates of (1) U.S. provisional patent application Ser. No. 60/383,917, filed on May 29, 2002, the disclosures of which are incorporated herein by reference.

The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; (32) U.S. provisional patent application Ser. No. 60/346,309, filed on Jan. 7, 2002; (33) U.S. provisional patent application Ser. No. 60/372,048, filed on Apr. 12, 2002; (34) U.S. provisional patent application Ser. No. 60/372,632, filed on Apr. 15, 2002; and (35) U.S. provisional patent application Ser. No. 60/380,147, filed on May 6, 2002, the disclosures of which are incorporated herein by reference.

BACKGROUND OF THE INVENTION

This invention relates generally to oil and gas exploration, and in particular to forming and repairing wellbore casings to facilitate oil and gas exploration and production.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing processes for forming and repairing wellbore casings.

SUMMARY OF THE INVENTION

According to one aspect of the present invention, a method of radially expanding and plastically deforming at least a portion of an expandable tubular member is provided that includes positioning a resilient member within the interior of the expandable tubular member, and compressing the resilient member within the interior of the expandable tubular member to radially expand and plastically deform a portion of the expandable tubular member.

According to another aspect of the present invention, a system for radially expanding and plastically deforming at least a portion of an expandable tubular member is provided that includes means for positioning a resilient member within the interior of the expandable tubular member, and means for compressing the resilient member within the interior of the expandable tubular member to radially expand and plastically deform a portion of the expandable tubular member.

According to another aspect of the present invention, an apparatus for radially expanding and plastically deforming an expandable tubular member is provided that includes a support member, a resilient member coupled to the support member, and an actuator operably coupled to the resilient member for controllably compressing the resilient member to thereby radially expand and plastically deform the expandable tubular member.

DETAILED DESCRIPTION OF THE ILLUSTRATIVE EMBODIMENTS

Figure 1A:
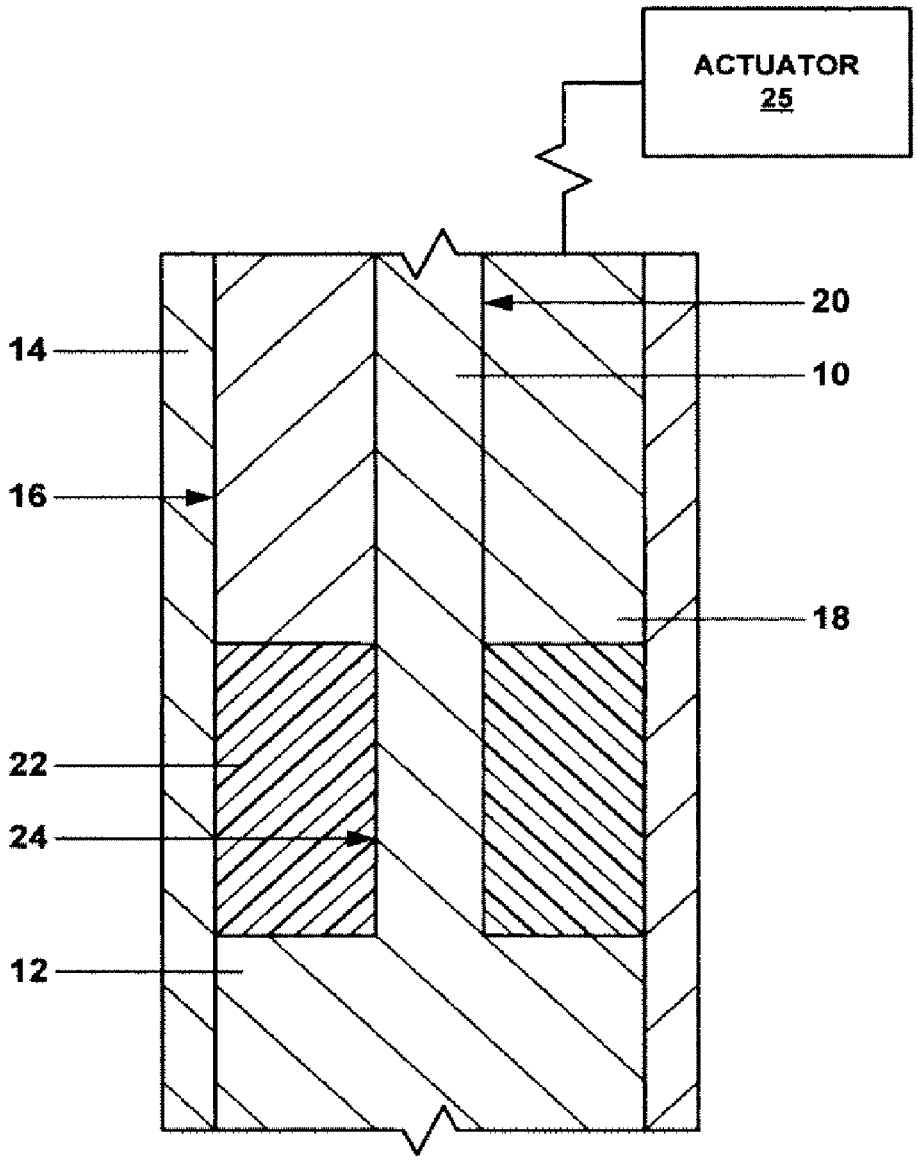
FIG. 1*a* is a fragmentary cross-sectional illustration of an exemplary embodiment of an apparatus for radially expanding and plastically deforming a tubular member.

Referring to FIG. 1*a*, a cylindrical member 10 that includes a flange 12 at one end is positioned within a first tubular member 14 that defines a passage 16 for receiving and mating with the flange of the cylindrical member. A second tubular member 18 that is received within and mates with the passage 16 of the first tubular member 14 defines a passage 20 that receives and mates with another end of the cylindrical member 10, and a third tubular member 22 that is also received within and mates with the passage of the first tubular member defines a passage 24 that receives and mates with an intermediate portion of the cylindrical member. In this manner, the third tubular member 22 is positioned between an end face of the second tubular member 18 and an end face of the flange 12 of the cylindrical member 10. An actuator 25 is operably coupled to the second tubular member 18 for controllably displacing the second tubular member relative to the cylindrical member 10 in the longitudinal direction. In an exemplary embodiment, the cylindrical member 10, the first tubular member 14, and the second tubular member 18 are fabricated from rigid materials such as, for example, aluminum or steel, and the third tubular member 22 is fabricated from resilient materials such as, for example, natural rubber, synthetic rubber, and/or an elastomeric material.

Figure 1B:
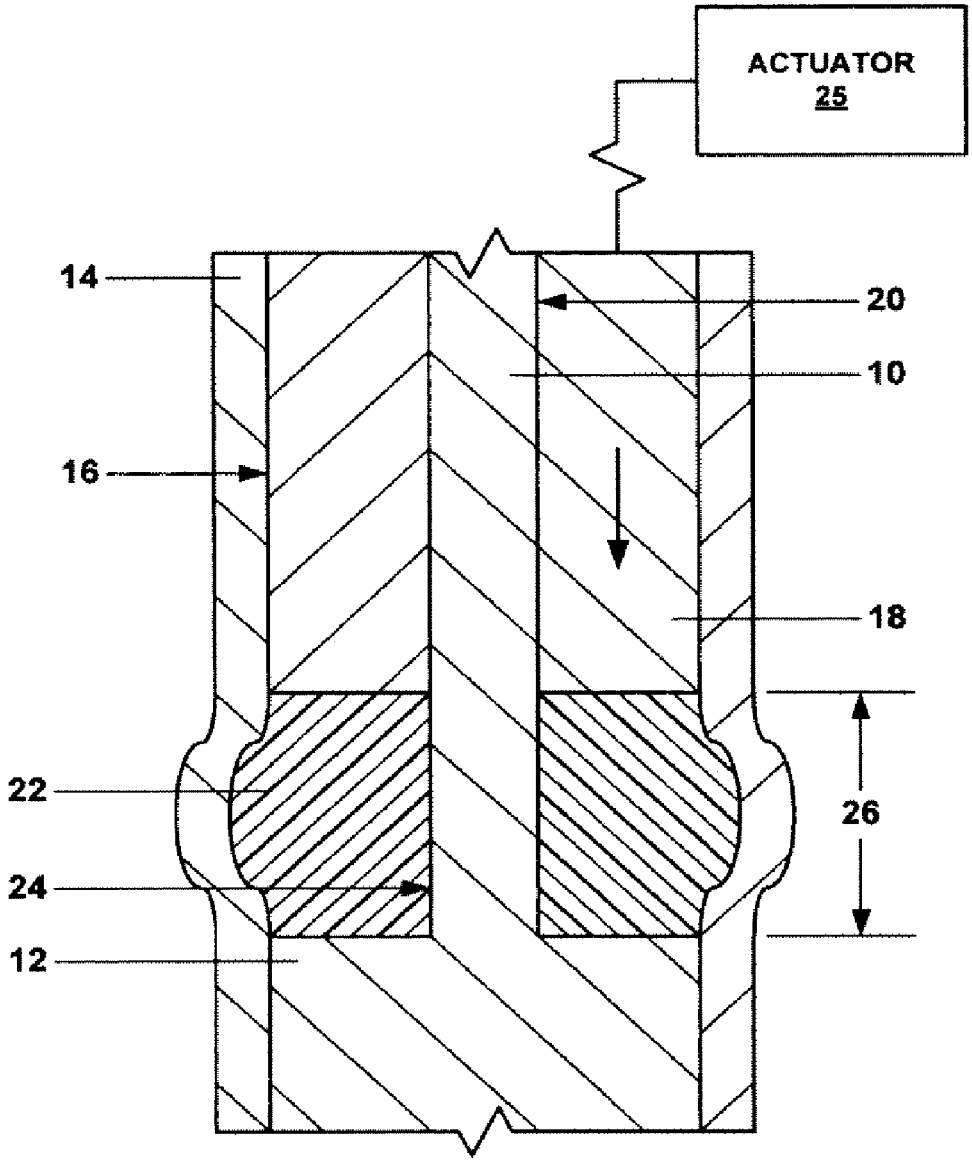
FIG. 1*b* is a fragmentary cross-sectional illustration of the apparatus of FIG. 1*a* after compressing the resilient expansion member to radially expand and plastically deform a portion of the expandable tubular member.

In an exemplary embodiment, as illustrated in FIG. 1*b*, the second tubular member 18 is then displaced downwardly in the longitudinal direction toward the flange 12 of the cylindrical member 10 by the actuator 25. As a result, the resilient third tubular member 22 is compressed in the longitudinal direction and expanded in the radial direction thereby radially expanding and plastically deforming the portion 26 of the first tubular member 14 proximate the radially expanded portion of the third tubular member 22. In an experimental implementation, the inside diameter of the portion 26 of the first tubular member 14 proximate the radially expanded portion of the third resilient tubular member 22 was unexpectedly increased by up to about 22 percent.

Figure 1C:
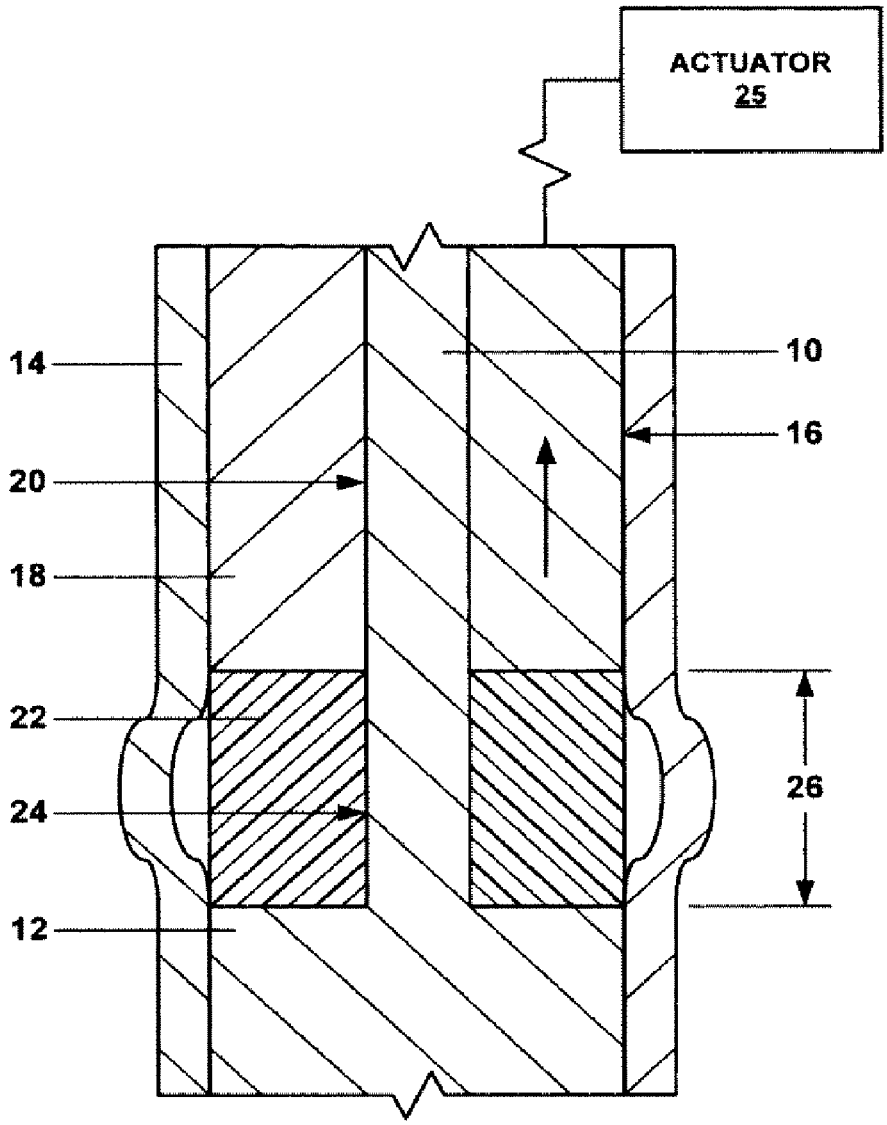
FIG. 1*c* is a fragmentary cross-sectional illustration of the apparatus of FIG. 1*b* after permitting the resilient expansion member to re-expand in the longitudinal direction.
Figure 1D:
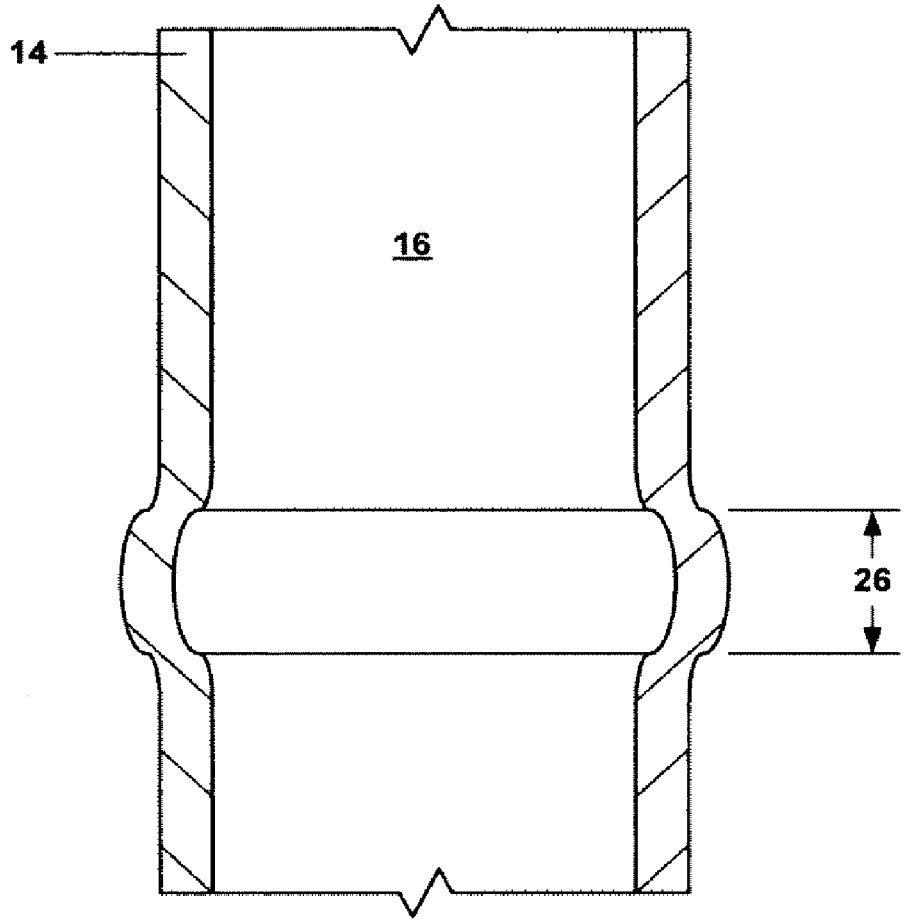
FIG. 1*d* is a fragmentary cross-sectional illustration of the apparatus of FIG. 1*c* after removing the resilient expansion member from the expandable tubular member.

In an exemplary embodiment, as illustrated in FIG. 1*c*, the second tubular member 18 is then displaced upwardly in the longitudinal direction away from the flange 12 of the cylindrical member 10 by the actuator 25. As a result, the resilient third tubular member 22 is no longer compressed in the longitudinal direction or expanded in the radial direction. As a result, as illustrated in FIG. 1*d*, the cylindrical member 10, the second tubular member 18, and the third tubular member 22 may then be removed from the passage 16 of the first tubular member 14.

Figure 1E:
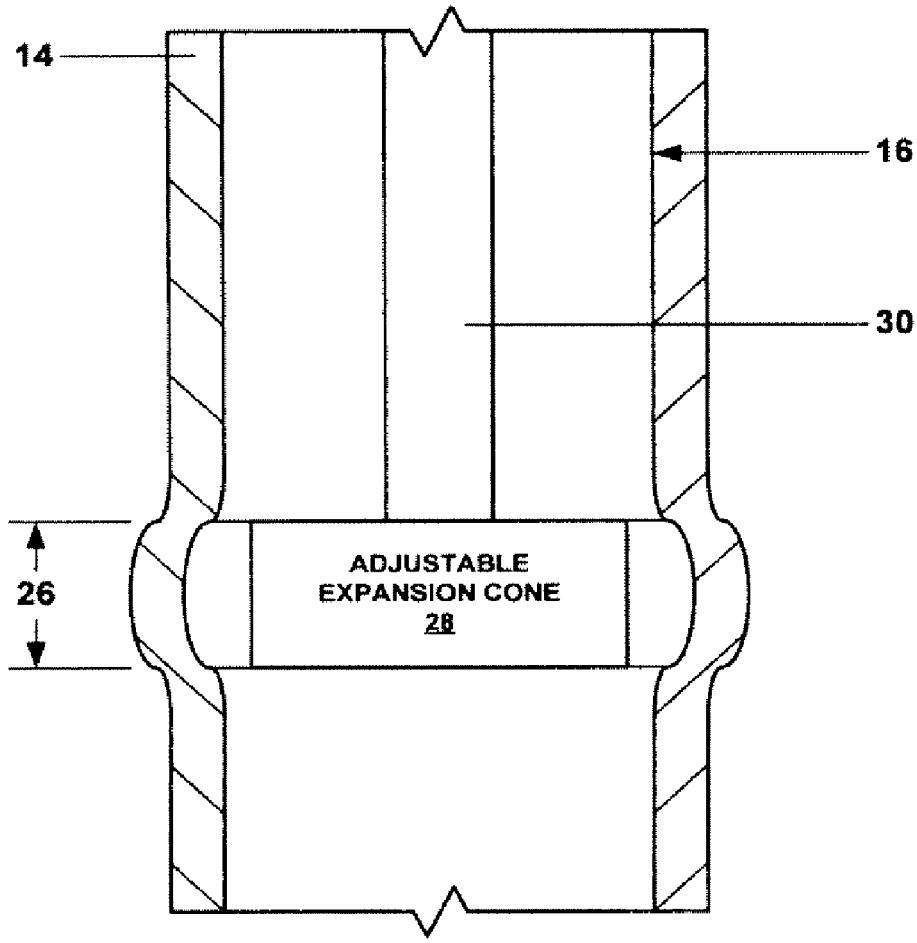
FIG. 1*e* is a fragmentary cross sectional illustration of the apparatus of FIG. 1*d* after positioning an adjustable expansion cone within the radially expanded and plastically deformed portion of the expandable tubular member.

In an exemplary embodiment, as illustrated in FIG. 1*e*, an adjustable expansion cone 28 is then positioned within the radially expanded portion 26 of the first tubular member 14 using a support member 30.

Figure 1F:
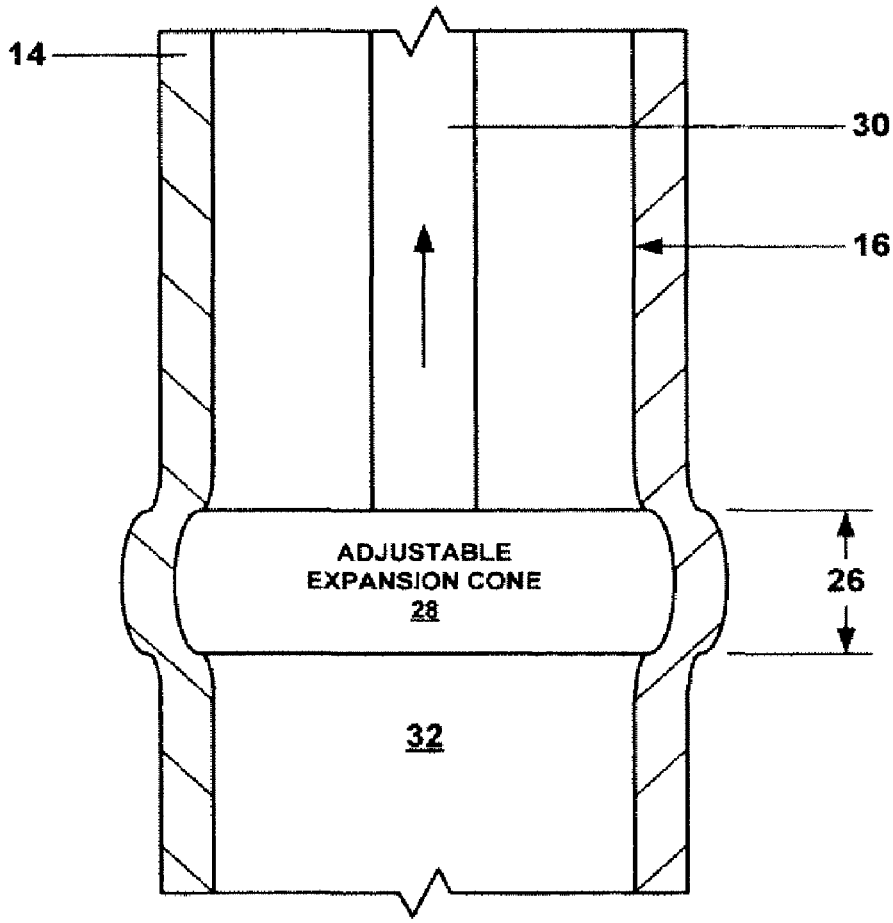
FIG. 1*f* is a fragmentary cross-sectional illustration of the apparatus of FIG. 1*e* after expanding the adjustable expansion cone within the radially expanded and plastically deformed portion of the expandable tubular member.
Figure 1G:
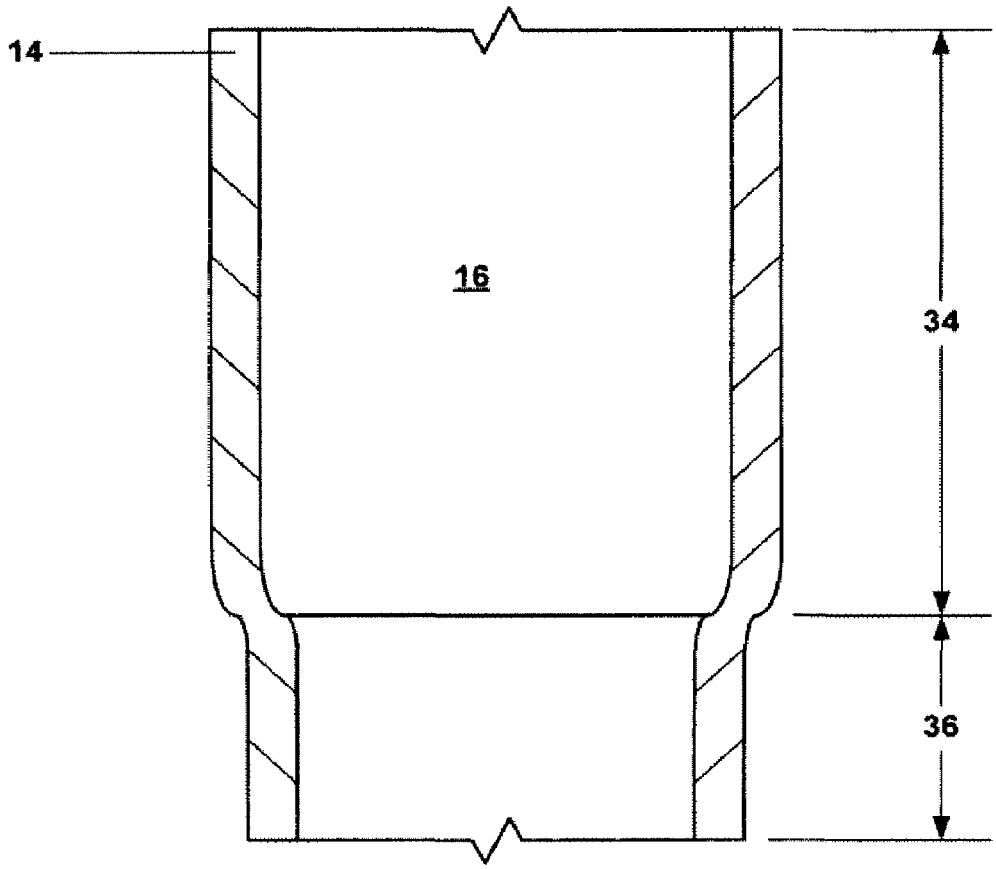
FIG. 1*g* is a fragmentary cross sectional illustration of the apparatus of FIG. 1*f* after displacing the adjustable expansion cone relative to the expandable tubular member to radially expand and plastically deform at least a portion of the expandable tubular member.

In an exemplary embodiment, as illustrated in FIG. 1*f*, the outside diameter of the adjustable expansion cone 28 is then increased to mate with the inside surface of at least a portion of the radially expanded portion 26 of the first tubular member 14. The adjustable expansion cone 28 is then displaced upwardly relative to the first tubular member 14. In several alternative embodiments, the adjustable expansion cone 28 is displaced upwardly relative to the first tubular member 14 by pulling the adjustable expansion cone 28 upwardly and/or by pressurizing the region 32 of the first tubular member below the adjustable expansion cone. In an exemplary embodiment, as illustrated in FIG. 1*g*, as a result of the upward displacement of the adjustable expansion cone 28 relative to the first tubular member 14, an upper portion 34 of the first tubular member is radially expanded and plastically deformed.

In several exemplary embodiments, the upper portion 34 of the first tubular member 14 is radially expanded and plastically deformed using the adjustable expansion cone 28 in a conventional manner and/or using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/3318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; (32) U.S. provisional patent application Ser. No. 60/346,309, filed on Jan. 7, 2002; (33) U.S. provisional patent application Ser. No. 60/372,048, filed on Apr. 12, 2002; (34) U.S. provisional patent application Ser. No. 60/372,632, filed on Apr. 15, 2002; and (35) U.S. provisional patent application Ser. No. 60/380,147, filed on May 6, 2002, the disclosures of which are incorporated herein by reference.

In several alternative embodiments, the upper portion 34 of the first tubular member 14 is radially expanded and plastically deformed using other conventional methods for radially expanding and plastically deforming tubular members such as, for example, internal pressurization and/or roller expansion devices such as, for example, that disclosed in U.S. patent application publication no. US 2001/0045284 A1, the disclosure of which is incorporated herein by reference.

In several alternative embodiments, the lower portion 36 of the first tubular member 14 is radially expanded and plastically deformed instead of, or in addition to, the upper portion 34.

Figure 2A:
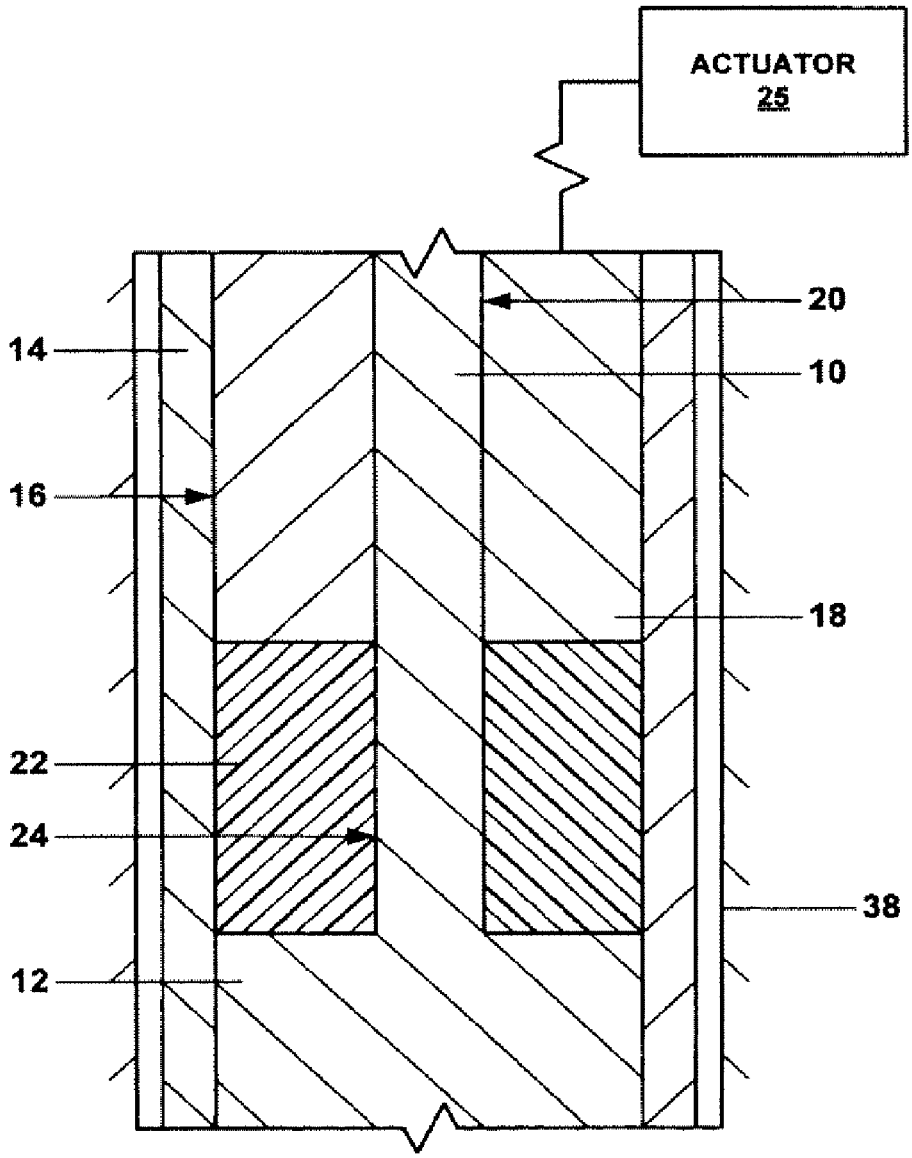
FIG. 2*a* is a fragmentary cross-sectional illustration of the apparatus of FIG. 1*a* after being positioned within a preexisting structure.

Referring to FIG. 2*a*, in an alternative embodiment, the cylindrical member 10, the first tubular member 14, the second tubular member 18, and the third tubular member 22 are positioned within the interior of a preexisting structure 38. In several exemplary embodiments, the preexisting structure 38 may be a wellbore, a wellbore casing, a pipeline, or a structural support.

Figure 2B:
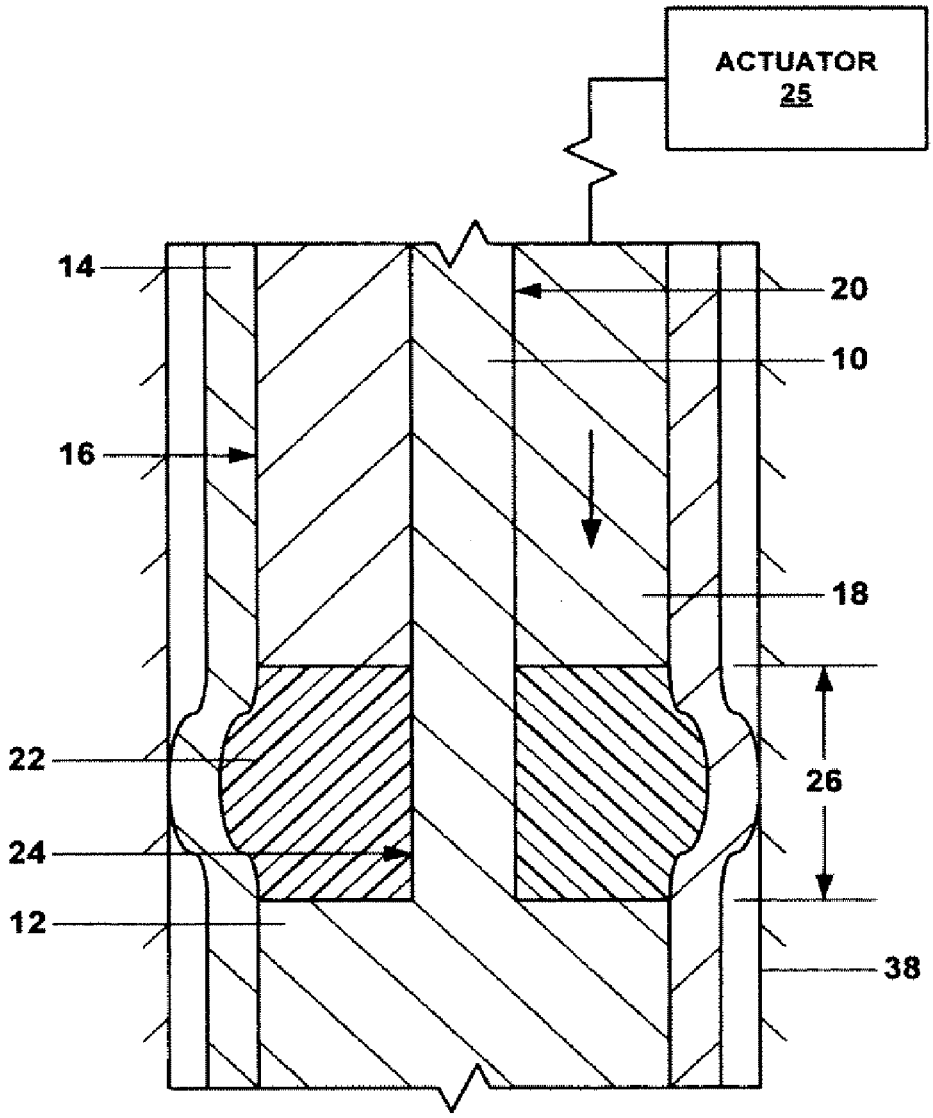
FIG. 2*b* is a fragmentary cross sectional of the apparatus of FIG. 2*a* after compressing the resilient expansion member to radially expand and plastically deform a portion of the expandable tubular member into intimate contact with the interior surface of the preexisting structure.

In an exemplary embodiment, as illustrated in FIG. 2*b*, the second tubular member 18 is then displaced downwardly in the longitudinal direction toward the flange 12 of the cylindrical member 10 using the actuator 25. As a result, the resilient third tubular member 22 is compressed in the longitudinal direction and expanded in the radial direction thereby radially expanding and plastically deforming the portion 26 of the first tubular member 14 proximate the radially expanded portion of the third tubular member 22 into intimate contact with the interior surface of the preexisting structure 38. In an experimental implementation, the inside diameter of the portion 26 of the first tubular member 14 proximate the radially expanded portion of the third resilient tubular member 22 was unexpectedly increased by up to about 22 percent. In an experimental implementation, the contact pressure between the radially expanded and plastically deformed portion 26 of the first tubular member 14 and the interior surface of the preexisting structure 38 provided a fluid tight seal and supported the first tubular member.

Figure 2C:
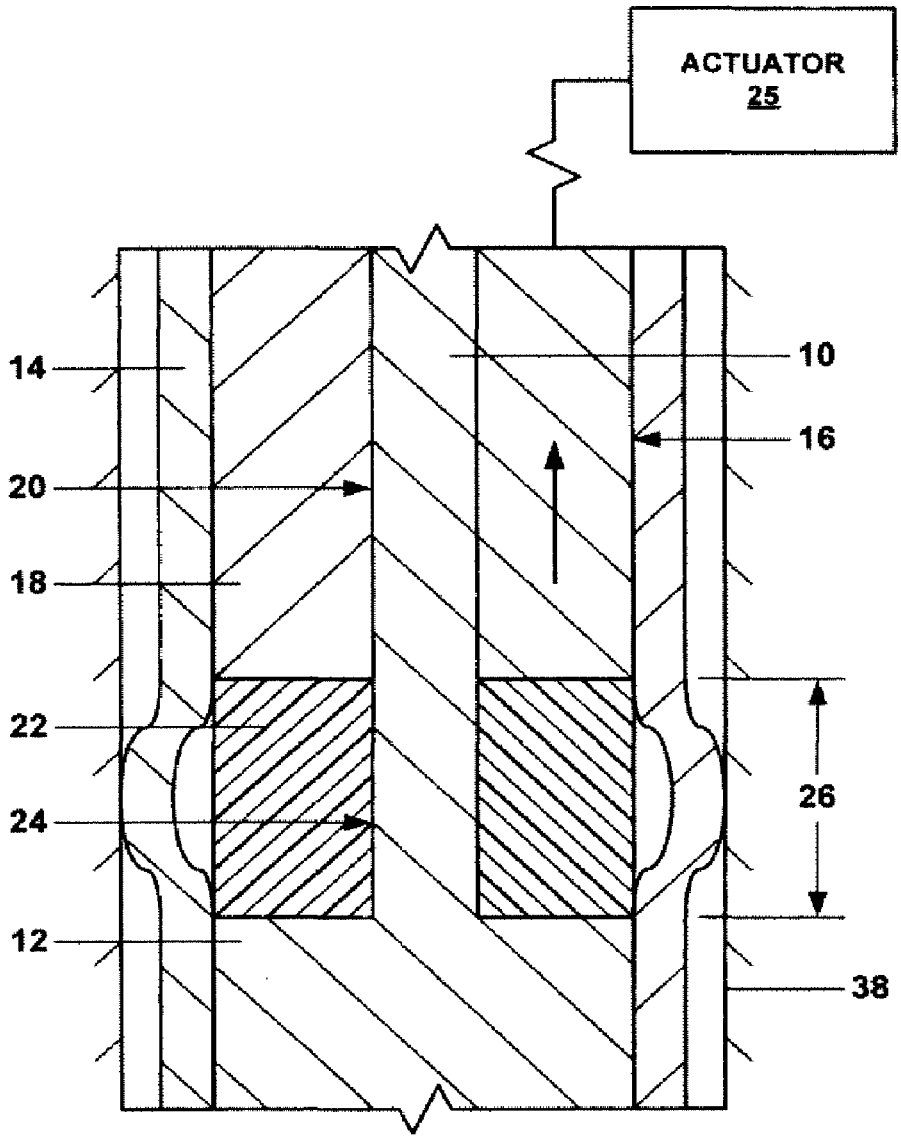
FIG. 2*c* is a fragmentary cross-sectional illustration of the apparatus of FIG. 2*b* after permitting the resilient expansion member to re-expand in the longitudinal direction.
Figure 2D:
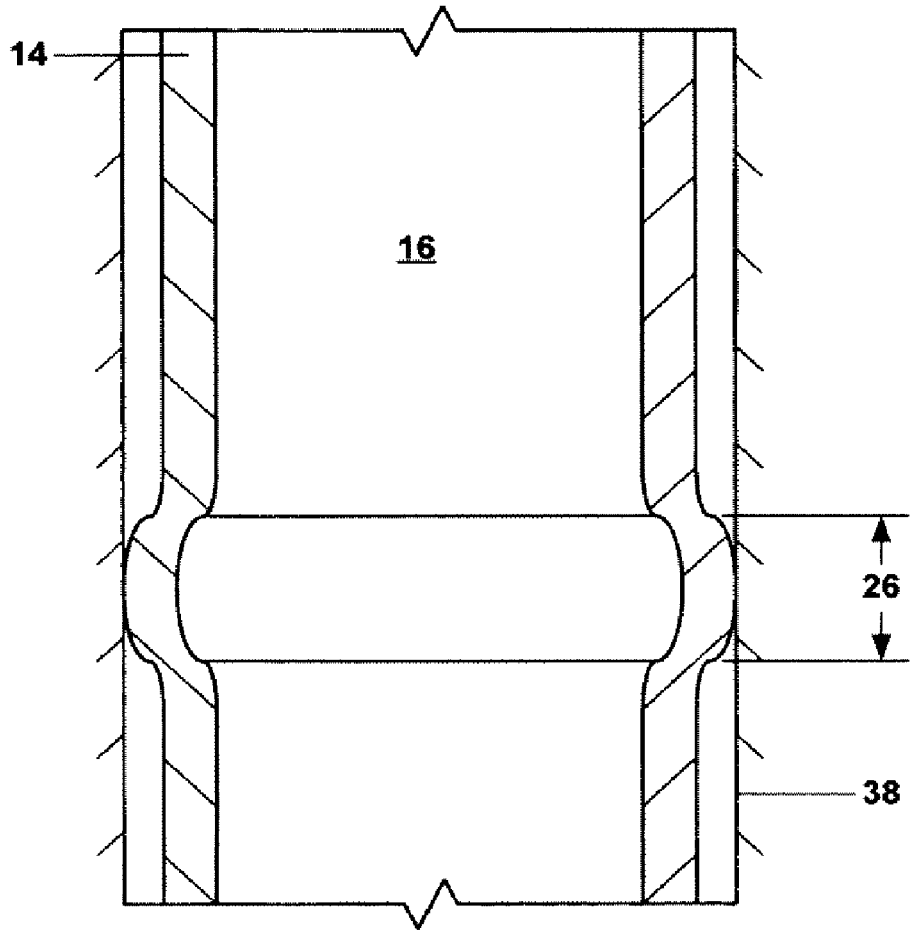
FIG. 2*d* is a fragmentary cross-sectional illustration of the apparatus of FIG. 2*c* after removing the resilient expansion member from the expandable tubular member.

In an exemplary embodiment, as illustrated in FIG. 2*c*, the second tubular member 18 is then displaced upwardly in the longitudinal direction away from the flange 12 of the cylindrical member 10 using the actuator 25. As a result, the resilient third tubular member 22 is no longer compressed in the longitudinal direction or expanded in the radial direction. As a result, as illustrated in FIG. 2*d*, the cylindrical member 10, the second tubular member 18, and the third tubular member 22 may then be removed from the passage 16 of the first tubular member 14.

Figure 2E:
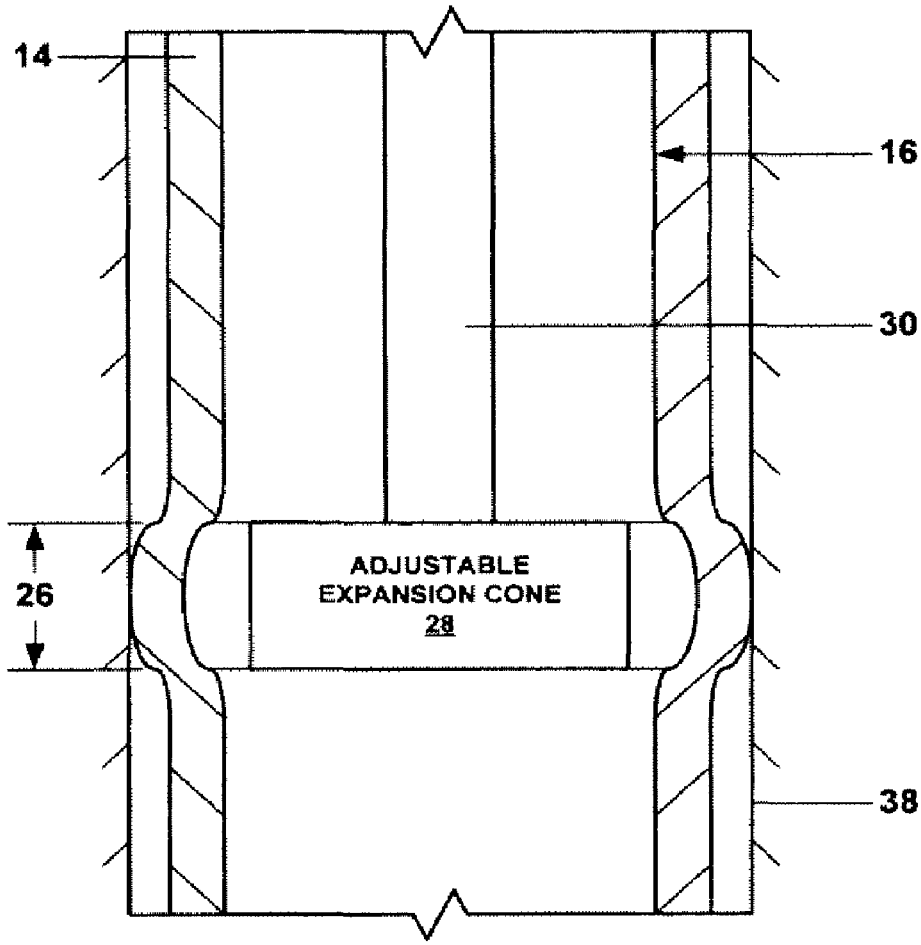
FIG. 2*e* is a fragmentary cross sectional illustration of the apparatus of FIG. 2*d* after positioning an adjustable expansion cone within the radially expanded and plastically deformed portion of the expandable tubular member.

In an exemplary embodiment, as illustrated in FIG. 2*e*, an adjustable expansion cone 28 is then positioned within the radially expanded portion 26 of the first tubular member 14 using a support member 30.

Figure 2F:
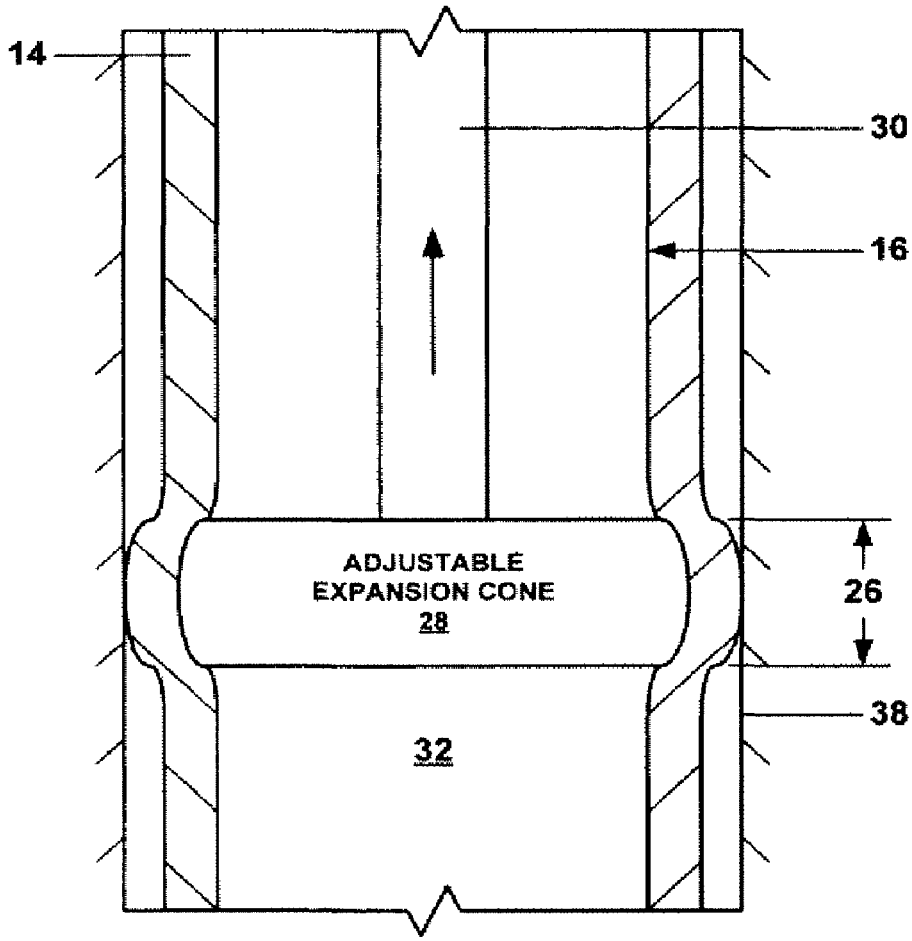
FIG. 2*f* is a fragmentary cross-sectional illustration of the apparatus of FIG. 2*e* after expanding the adjustable expansion cone within the radially expanded and plastically deformed portion of the expandable tubular member.
Figure 2G:
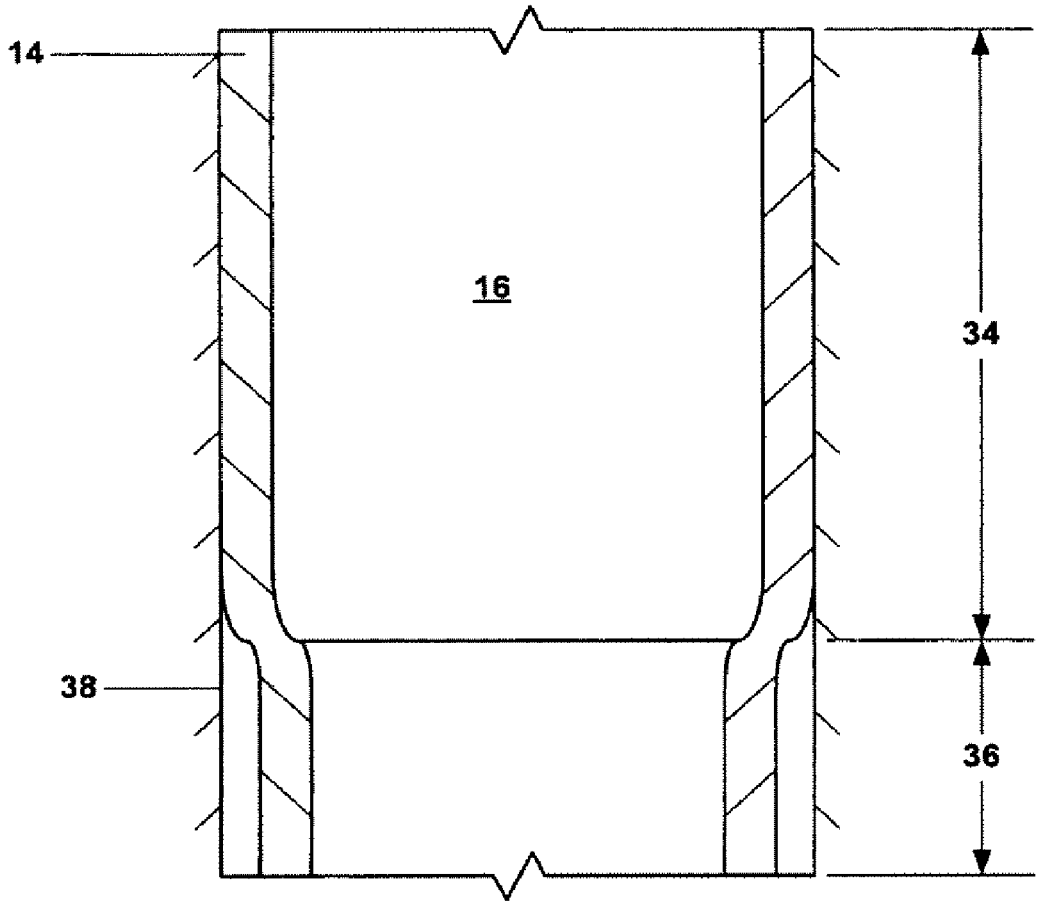
FIG. 2*g* is a fragmentary cross sectional illustration of the apparatus of FIG. 2*f* after displacing the adjustable expansion cone relative to the expandable tubular member to radially expand and plastically deform at least a portion of the expandable tubular member.

In an exemplary embodiment, as illustrated in FIG. 2*f*, the outside diameter of the adjustable expansion cone 28 is then increased to mate with the inside surface of at least a portion of the radially expanded portion 26 of the first tubular member 14. The adjustable expansion cone 28 is then displaced upwardly relative to the first tubular member 14. In several alternative embodiments, the adjustable expansion cone 28 is displaced upwardly relative to the first tubular member 14 by pulling the adjustable expansion cone 28 upwardly and/or by pressurizing the region 32 of the first tubular member below the adjustable expansion cone. In an exemplary embodiment, as illustrated in FIG. 2*g*, as a result of the upward displacement of the adjustable expansion cone 28 relative to the first tubular member 14, an upper portion 34 of the first tubular member is radially expanded and plastically deformed. In an exemplary experimental implementation, the upward displacement of the adjustable expansion cone 28 relative to the first tubular member 14, caused the upper portion 34 of the first tubular member to be radially expanded and plastically deformed into intimate contact with the interior surface of the preexisting structure.

Figure 3:
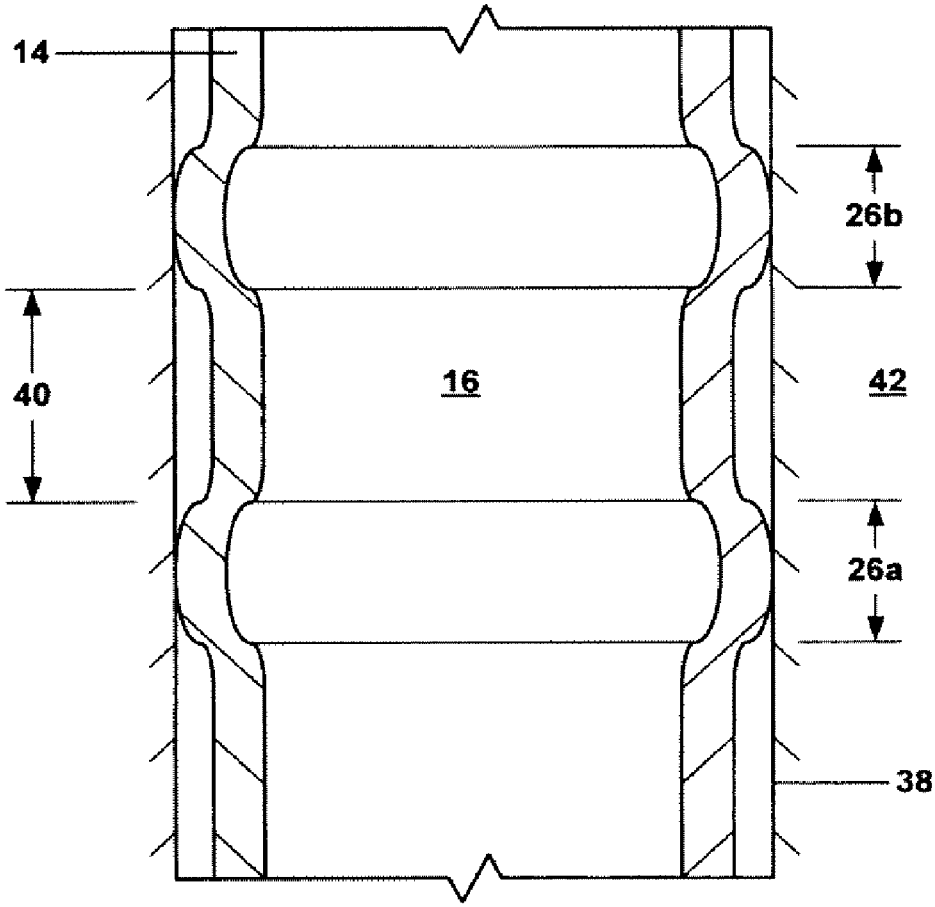
FIG. 3 is a fragmentary cross-sectional illustration of the radial expansion and plastic deformation of the expandable tubular member of FIG. 2*a* at a plurality of discrete locations by repeating the operational steps of FIGS. 2*a*-2*c* a plurality of times within the preexisting structure.

In an alternative embodiment, as illustrated in FIG. 3, the first tubular member 14 is radially expanded and plastically deformed into intimate contact with the preexisting structure 38 at a plurality of spaced apart locations by operating the cylindrical member 10, the first tubular member 14, the second tubular member 18, and the third tubular member 22 a plurality of times as described above with reference to FIGS. 2*a*-2*c*. As a result, radially expanded and plastically deformed portions, 26*a* and 26*b*, of the first tubular member 14 are thereby radially expanded and plastically deformed into intimate contact with interior surface of the preexisting structure 38. In an exemplary experimental implementation, the radially expanded and plastically deformed portions, 26*a* and

26*b*, of the first tubular member 14 provided a fluid tight seal between the radially expanded portions and the interior surface of the preexisting structure 38. In an exemplary embodiment, the intermediate portion 40 of the first tubular member 14, positioned between the radially expanded and plastically deformed portions, 26*a* and 26*b*, of the first tubular member, includes one or more openings, slots, and/or apertures for conveying fluidic materials into and/or out of the first tubular member. In this manner, fluidic materials within a subterranean formation 42 positioned proximate the intermediate portion may be extracted into the interior 16 of the first tubular member. Or, alternatively, fluidic materials may be injected into the subterranean formation. In several alternative embodiments, the subterranean formation 42 may include a source of hydrocarbons such as, for example, petroleum and/or natural gas, and/or a source of geothermal energy.

Figure 4:
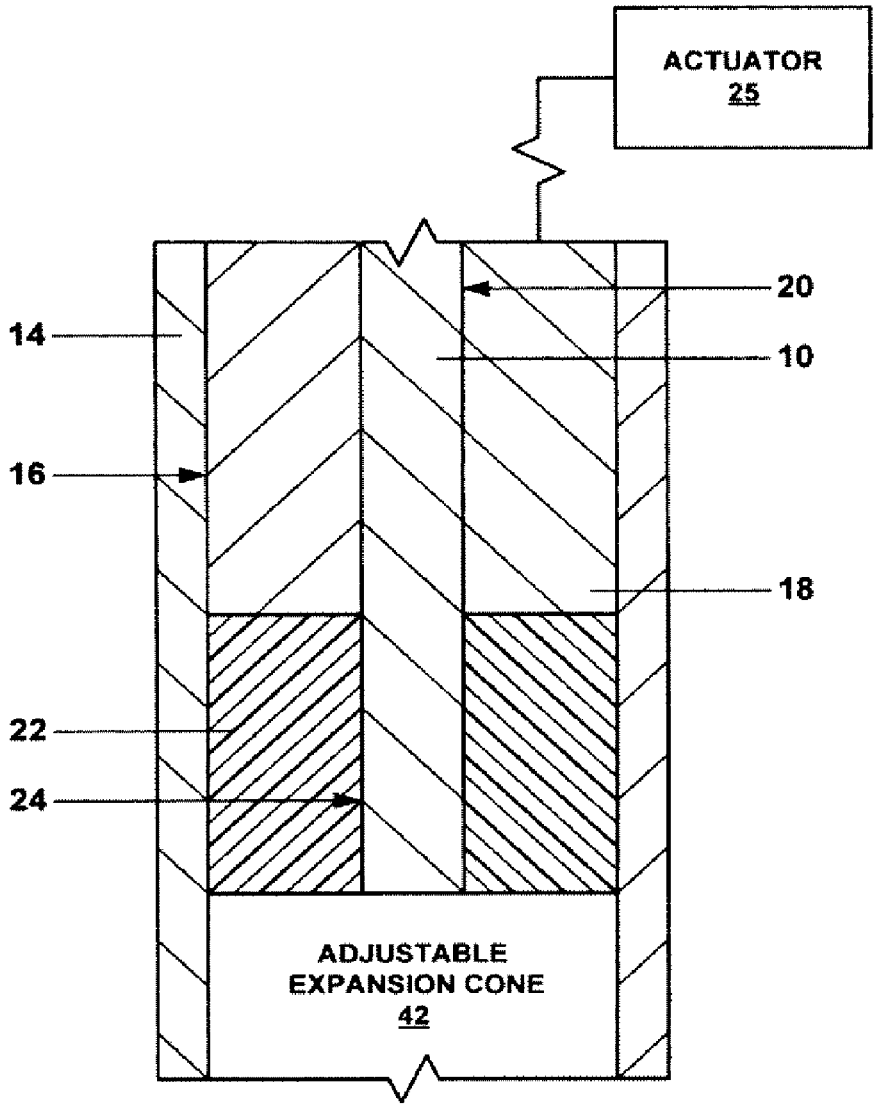
FIG. 4 is a fragmentary cross sectional illustration of an alternative embodiment of the apparatus of FIG. 1*a* in which an adjustable expansion cone is provided below the resilient expansion member.

In an alternative embodiments, as illustrated in FIG. 4, an adjustable expansion cone 42 is coupled to the cylindrical member 10 below the resilient third tubular member 22. In this manner, during operation, after expanding the resilient tubular member 22 in the radial direction to thereby radially expand and plastically deform the first tubular member 14, the adjustable expansion cone 42 may then be positioned proximate the radially expanded portion of the first tubular member and radially expanded. The adjustable expansion cone 42 may then be displaced upwardly and/or downwardly relative to the first tubular member 14 in the longitudinal direction to thereby radially expand and plastically deform at least a portion of the first tubular member.

A method of radially expanding and plastically deforming at least a portion of an expandable tubular member has been described that includes positioning a resilient member within the interior of the expandable tubular member, and compressing the resilient member within the interior of the expandable tubular member to radially expand and plastically deform a portion of the expandable tubular member. In an exemplary embodiment, the inside diameter of the radially expanded portion of the expandable tubular member is increased by up to about 22 percent during the radial expansion and plastic deformation. In an exemplary embodiment, the method further includes positioning an adjustable expansion cone within the radially expanded and plastically deformed portion of the expandable tubular member, expanding the adjustable expansion cone within the radially expanded and plastically deformed portion of the expandable tubular member, and displacing the adjustable expansion cone relative to the expandable tubular member in the longitudinal direction to radially expand and plastically deform another portion of the expandable tubular member. In an exemplary embodiment, the method further includes decompressing the resilient member within the interior of the expandable tubular member, positioning the resilient member to another location within the interior of the expandable tubular member, and compressing the resilient member within the interior of the expandable tubular member to radially expand and plastically deform another portion of the expandable tubular member. In an exemplary embodiment, the method further includes positioning the expandable tubular member within a preexisting structure. In an exemplary embodiment, the preexisting structure includes a wellbore. In an exemplary embodiment, the preexisting structure includes a wellbore casing. In an exemplary embodiment, the preexisting structure includes a pipeline. In an exemplary embodiment, the preexisting structure includes a structural support. In an exemplary embodiment, the method further includes compressing the resilient member within the interior of the expandable tubular member to radially expand and plastically deform a portion of the expandable tubular member into contact with the interior surface of the preexisting structure. In an exemplary embodiment, the method further includes decompressing the resilient member within the interior of the expandable tubular member, positioning the resilient member to another location within the interior of the expandable tubular member, and compressing the resilient member within the interior of the expandable tubular member to radially expand and plastically deform another portion of the expandable tubular member into contact with the interior surface of the preexisting structure. In an exemplary embodiment, the intermediate portion of the expandable tubular member positioned between the radially expanded and plastically deformed portions defines one or more radial openings for conveying fluidic materials between the interiors of the expandable tubular member and the preexisting structure. In an exemplary embodiment, the preexisting structure includes a wellbore that traverses a subterranean formation. In an exemplary embodiment, the subterranean formation includes a source of geothermal energy. In an exemplary embodiment, the subterranean formation includes a source of hydrocarbons. In an exemplary embodiment, the method further includes compressing the resilient member in the longitudinal direction within the interior of the expandable tubular member to radially expand and plastically deform a portion of the expandable tubular member. In an exemplary embodiment, the resilient member is a resilient tubular member. In an exemplary embodiment, the expandable tubular member is a solid expandable tubular member. In an exemplary embodiment, the expandable tubular member defines one or more radial openings for conveying fluidic materials.

A system for radially expanding and plastically deforming at least a portion of an expandable tubular member has been described that includes means for positioning a resilient member within the interior of the expandable tubular member, and means for compressing the resilient member within the interior of the expandable tubular member to radially expand and plastically deform a portion of the expandable tubular member. In an exemplary embodiment, the inside diameter of the radially expanded portion of the expandable tubular member is increased by up to about 22 percent during the radial expansion and plastic deformation. In an exemplary embodiment, the system further includes means for positioning an adjustable expansion cone within the radially expanded and plastically deformed portion of the expandable tubular member, means for expanding the adjustable expansion cone within the radially expanded and plastically deformed portion of the expandable tubular member, and means for displacing the adjustable expansion cone relative to the expandable tubular member in the longitudinal direction to radially expand and plastically deform another portion of the expandable tubular member. In an exemplary embodiment, the system further includes means for decompressing the resilient member within the interior of the expandable tubular member, means for positioning the resilient member to another location within the interior of the expandable tubular member, and means for compressing the resilient member within the interior of the expandable tubular member to radially expand and plastically deform another portion of the expandable tubular member. In an exemplary embodiment, the system further includes means for positioning the expandable tubular member within a preexisting structure. In an exemplary embodiment, the preexisting structure includes a wellbore. In an exemplary embodiment, the preexisting structure includes a wellbore casing. In an exemplary embodiment, the preexisting structure includes a pipeline. In an exemplary embodiment, the preexisting structure includes a structural support. In an exemplary embodiment, the system further includes means for compressing the resilient member within the interior of the expandable tubular member to radially expand and plastically deform a portion of the expandable tubular member into contact with the interior surface of the preexisting structure. In an exemplary embodiment, the system further includes means for decompressing the resilient member within the interior of the expandable tubular member, means for positioning the resilient member to another location within the interior of the expandable tubular member, and means for compressing the resilient member within the interior of the expandable tubular member to radially expand and plastically deform another portion of the expandable tubular member into contact with the interior surface of the preexisting structure. In an exemplary embodiment, an intermediate portion of the expandable tubular member positioned between the radially expanded and plastically deformed portions defines one or more radial openings for conveying fluidic materials between the interiors of the expandable tubular member and the preexisting structure. In an exemplary embodiment, the preexisting structure includes a wellbore that traverses a subterranean formation. In an exemplary embodiment, the subterranean formation includes a source of geothermal energy. In an exemplary embodiment, the subterranean formation includes a source of hydrocarbons. In an exemplary embodiment, the system further includes means for compressing the resilient member in the longitudinal direction within the interior of the expandable tubular member to radially expand and plastically deform a portion of the expandable tubular member. In an exemplary embodiment, the resilient member includes a resilient tubular member. In an exemplary embodiment, the expandable tubular member is a solid expandable tubular member. In an exemplary embodiment, the expandable tubular member defines one or more radial openings for conveying fluidic materials.

An apparatus for radially expanding and plastically deforming an expandable tubular member has been described that includes a support member, a resilient member coupled to the support member, and an actuator operably coupled to the resilient member for controllably compressing the resilient member to thereby radially expand and plastically deform the expandable tubular member. In an exemplary embodiment, the resilient member includes a tubular resilient member. In an exemplary embodiment, the apparatus further includes an adjustable expansion cone coupled to the support member. In an exemplary embodiment, the actuator is adapted to compress the resilient member in the longitudinal direction and thereby cause the resilient member to expand in the radial direction. In an exemplary embodiment, the support member is fabricated from a rigid material. In an exemplary embodiment, the rigid material is selected from the group consisting of steel and aluminum. In an exemplary embodiment, the resilient member is fabricated from materials selected from the group consisting of natural rubber, synthetic rubber, and elastomeric material.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. An apparatus for radially expanding and plastically deforming an expandable tubular member; comprising:

a support member;

a resilient member coupled to the support member;

an actuator operably coupled to the resilient member for controllably compressing the resilient member to thereby radially expand and plastically deform the expandable tubular member; and an adjustable expansion device coupled to the support member and translatable relative to the expandable tubular member to thereby radially expand and plastically deform the expandable tubular member.

2. The apparatus of claim 1, wherein the resilient member comprises a tubular resilient member.

3. The apparatus of claim 2, wherein the resilient member comprises a tubular elastomeric member.

4. The apparatus of claim 1, wherein the actuator is adapted to compress the resilient member in the longitudinal direction and thereby cause the resilient member to expand in the radial direction.

5. The apparatus of claim 1, wherein the support member is fabricated from a rigid material.

6. The apparatus of claim 5, wherein the rigid material is selected from the group consisting of steel and aluminum.

7. The apparatus of claim 1, wherein the resilient member is fabricated from materials selected from the group consisting of natural rubber, synthetic rubber, and elastomeric material.

8. A method of radially expanding and plastically deforming at least a portion of an expandable tubular member, comprising:

coupling a resilient member and an expansion device to a support member;

positioning the support member and the resilient member within the expandable tubular member;

compressing the resilient member within the interior of the expandable tubular member to radially expand and plastically deform a portion of the expandable tubular member;

positioning the expansion device within the radially expanded and plastically deformed portion of the expandable tubular member; and translating the expansion device to radially expand and plastically deform another portion of the expandable tubular member,

9. The method of claim 8, wherein the expansion device comprises an adjustable expansion device.

10. The method of claim 8, wherein the expansion device comprises a rotary expansion device.

11. The method of claim 8, wherein the expansion device comprises a pressurization device.

12. An apparatus for radially expanding and plastically deforming an expandable tubular member, comprising:

a support member;

a resilient member coupled to the support member;

an actuator operably coupled to the resilient member for controllably compressing the resilient member to thereby radially expand and plastically deform the expandable tubular member; and an expansion device coupled to the support member and translatable relative to the expandable tubular member to thereby radially expand and plastically deform the expandable tubular member.

13. The apparatus of claim 12, wherein the expansion device comprises an adjustable expansion device.

14. The apparatus of claim 12, wherein the expansion device comprises a rotary expansion device.

15. The apparatus of claim 12, wherein the expansion device comprises a pressurization device.

16. A method of radially expanding and plastically deforming at least a portion of an expandable tubular member, comprising:

coupling a resilient member and an expansion device to a support member;

positioning the support member within the expandable tubular member, wherein the resilient member is within the interior of the expandable tubular member;

compressing the resilient member within the interior of the expandable tubular member to radially expand and plastically deform a portion of the expandable tubular member;

positioning an expansion device within the expandable tubular member; and translating the expansion device relative to the expandable tubular member to radially expand and plastically deform the expandable tubular member.

17. The method of claim 16, wherein the expansion device comprises an adjustable expansion device.

18. The method of claim 16, wherein the expansion device comprises a rotary expansion device.

19. The method of claim 16, wherein the expansion device comprises a pressurization device.

20. A method of radially expanding and plastically deforming an expandable tubular member, comprising:

coupling a resilient member and an expansion device to a support member;

positioning the support member within the expandable tubular member, wherein the resilient member is within the interior of the expandable tubular member;

compressing the resilient member within the interior of the expandable tubular member to radially expand and plastically deform a portion of the expandable tubular member;

positioning an expansion device within the expandable tubular member; and operating the expansion device to radially expand and plastically deform the remaining portions of the expandable tubular member.

21. The method of claim 20, wherein the expansion device comprises an adjustable expansion device.

22. The method of claim 20, wherein the expansion device comprises a rotary expansion device.

23. The method of claim 20, wherein the expansion device comprises a pressurization device.

24. A method of radially expanding and plastically deforming an expandable tubular member, comprising:

coupling a resilient member and an expansion device that does not comprise the resilient member to a support member;

positioning the support member within the expandable tubular member, wherein the resilient member is within the interior of the expandable tubular member;

compressing the resilient member within the interior of the expandable tubular member to radially expand and plastically deform a portion of the expandable tubular member; and radially expanding and plastically deforming the expandable tubular member using the expansion device.

25. The method of claim 24, wherein the expansion device comprises an adjustable expansion device.

26. The method of claim 24, wherein the expansion device comprises a rotary expansion device.

27. The method of claim 24, wherein the expansion device comprises a pressurization device.

28. An apparatus for radially expanding and plastically deforming an expandable tubular member, comprising:

a support member;

a resilient member coupled to the support member;

an actuator operably coupled to the resilient member for controllably compressing the resilient member to thereby radially expand and plastically deform the expandable tubular member; and an expansion device coupled to the support member that does not comprise the resilient member.

29. The apparatus of claim 28, wherein the expansion device comprises an adjustable expansion device.

30. The apparatus of claim 28, wherein the expansion device comprises a rotary expansion device.

31. The apparatus of claim 28, wherein the expansion device comprises a pressurization device.

32. A method of radially expanding and plastically deforming an expandable tubular member; comprising:

deploying a resilient member coupled to a support member within the expandable tubular member;

compressing the resilient member within the interior of the expandable tubular member to radially expand and plastically deform a portion of the expandable tubular member; and translating the support member relative to the expandable tubular member so as to radially expand and plastically deform the expandable tubular while the support member is being translated.

33. The method of claim 32, further comprising deploying an expansion device within the expandable tubular member,

34. The method of claim 33, wherein the expansion device is an adjustable expansion device.

* * * * *